US005267776A

United States Patent [19]

Fromson

[11] Patent Number: 5,267,776

[45] Date of Patent: Dec. 7, 1993

[54] MODULAR CHAIR

[76] Inventor: Howard A. Fromson, 60 Main St., Rockville, Conn. 06066

[21] Appl. No.: 848,234

[22] Filed: Mar. 9, 1992

[51] Int. Cl.[5] ..... A47C 15/00

[52] U.S. Cl. ..... 297/232; 297/248; 297/445

[58] Field of Search ..... 297/232, 248, 445, 463; D6/334, 335, 357, 363

[56] References Cited

U.S. PATENT DOCUMENTS 3,729,229 4/1973 Minsker ..... 297/248 X

FOREIGN PATENT DOCUMENTS 2000121 7/1971 Fed. Rep. of Germany ..... 297/445

706165 6/1931 France ..... 297/232

7212572 3/1973 Netherlands ..... 297/248

1204245 9/1970 United Kingdom ..... 297/445

1543419 4/1979 United Kingdom ..... 297/232

*Primary Examiner*—Laurie K. Cranmer

*Attorney, Agent, or Firm*—Felfe & Lynch

[57] ABSTRACT

Two tetrahedrons are fixed together at a common joint and provided with a seat fixed between faces of respective tetrahedrons and parallel to a support plane formed by two joints meeting the common joint at the common joint. For equilateral tetrahedrons which meet at an angle of 109°30′ between faces, plural seating can be provided by fixing three or more tetrahedrons together in a variety of configurations having a common support plane and seats parallel thereto.

20 Claims, 3 Drawing Sheets

1/3

MODULAR CHAIR

BACKGROUND OF THE INVENTION

The invention relates to a chair constructed of tetrahedral members.

While chairs have been around for thousands of years, the basic structural member has generally been rectangular and does not lend itself to modular construction.

There is also the need, in some environments, for a plural chair structure which offers some isolation between chairs, thereby offering their occupants some privacy.

It would therefore be desirable to realize a modular chair construction offering some spacing between seats, especially a construction which may be assembled in a variety of seating configurations.

SUMMARY OF THE INVENTION

The modular chair of the present invention has two tetrahedrons fixed together along a common joint and provided with a seat.

Each tetrahedron, like all tetrahedrons, has four triangular faces joined at six joints to form a solid. In the inventive chair, one face of each tetrahedron meets one of the faces of another tetrahedron along a common joint to enclose an external angle outside of the tetrahedrons. Each tetrahedron further has a support joint which meets the support joint of the other tetrahedron at a corner common to the common joint to define a support plane. A support member fixed between the faces enclosing the external angle serves as a seat.

When the tetrahedron is an equilateral tetrahedron having four faces outlined by equilateral triangles, the internal angle between each pair of faces is 70°30′. When the external angle described above is 109°30′, three or more tetrahedrons may be fixed together along common joints to provide plural seating in a variety of arrangements.

According to one arrangement, four tetrahedrons are placed together so that their support joints outline a square and four outwardly facing seats are provided.

The tetrahedrons may also be placed together in a linear arrangement so that a plurality "n" of tetrahedrons provides a plurality "n−1" of seats. This arrangement may extend in straight arrays, the support legs being in a zig-zag pattern, so that adjacent seats face in opposite directions. Such straight arrays may meet at right angles along a common joint to accommodate the corner of a room, for example.

The latter described construction would be especially desirable in the waiting area at an airport gate. One contingent of waiting passengers would sit in an L-shaped array facing the tarmac, while another contingent would sit in an inwardly facing L-shaped array. Both contingents would enjoy spacious personal seating in a striking geometric environment.

An advantage of the tetrahedral members is their structural strength and stability, which is especially pronounced in multiple seating arrays.

DETAILED DESCRIPTION OF THE PREFERRED EMBODIMENTS

Figure 1:
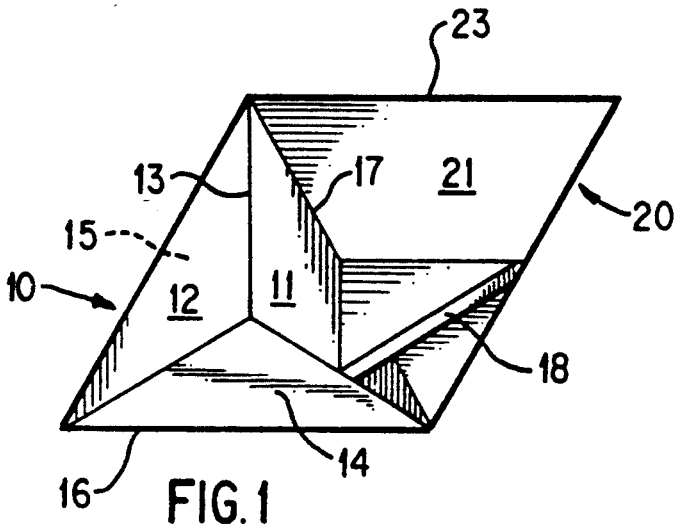
FIG. 1 is a perspective view of the chair.
Figure 2:
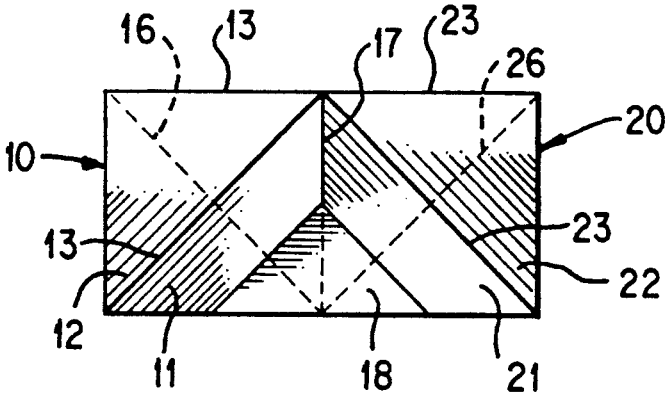
FIG. 2 is a plan view of the chair.
Figure 3:
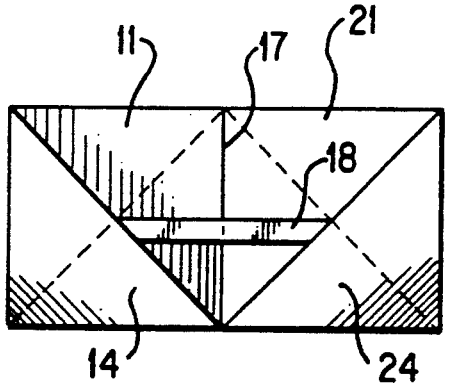
FIG. 3 is a front view of the chair.
Figure 4:
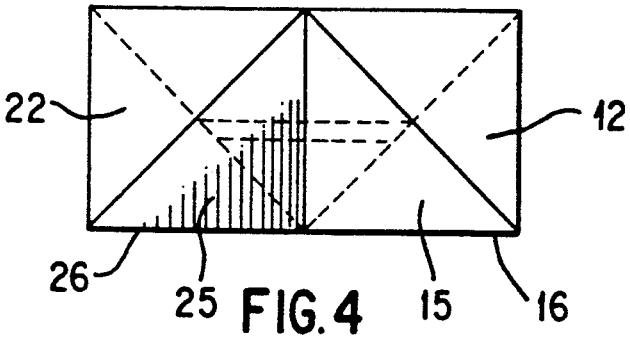
FIG. 4 is a rear view of the chair.
Figure 5:
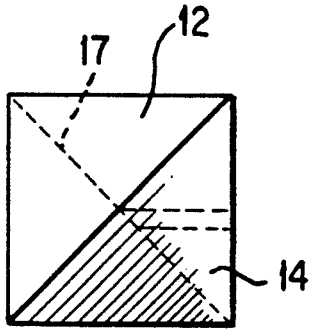
FIG. 5 is a left end view of the chair.
Figure 6:
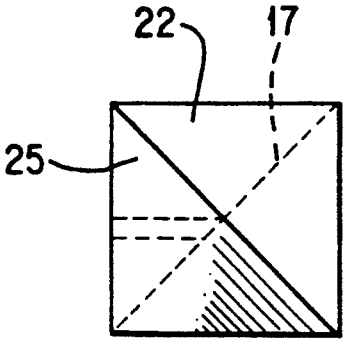
FIG. 6 is a right end view of the chair.

FIGS. 1–6 depict a single chair formed by two equilateral tetrahedrons 10, 20. The tetrahedron 10 has two upwardly facing faces 11, 12 which meet at a top joint 13, and two downwardly facing faces 14, 15 which meet at a support joint 16. The tetrahedron 20 has two upwardly facing faces 21, 22 which meet at a top joint 23 and two downwardly facing faces 24, 25 which meet at a support joint 26. The faces 11, 21 meet at a common joint 17 to enclose an external angle of 109°30′. A support member 18 fixed between faces 11, 21 is parallel to the plane of top joints 13, 23 and to the plane of support joints 16, 26.

Figure 7:
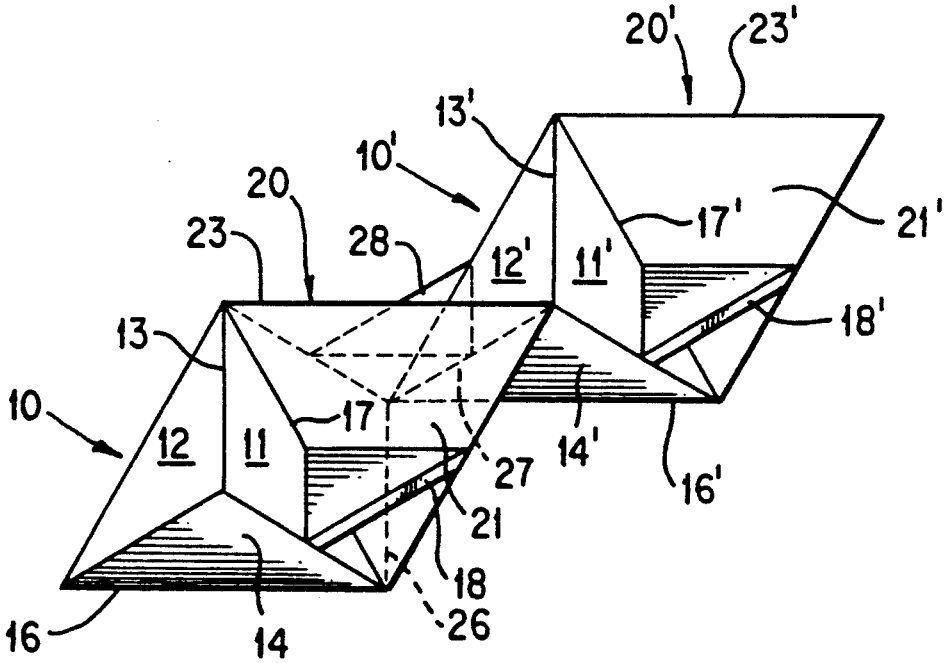
FIG. 7 is a perspective of four tetrahedrons linearly arranged to provide three seats.

FIG. 7 shows an array of four trapezoidal members 10, 20, 10′, 20′ fixed at common joints 17, 27, 17′ to form a linear array wherein alternate seats face in the same direction. The members 10′, 20′ repeat the unit formed by members 10, 20, the upward faces 22 and 12′ providing for an oppositely facing support member 28, while the faces 11′, 21′ provide for a seat 18′ facing as seat 18. Note that the top joints 13, 23, 13′, 23′ lie in a common plane parallel to the plane of support joints 16, 26, 16′.

Figure 8:
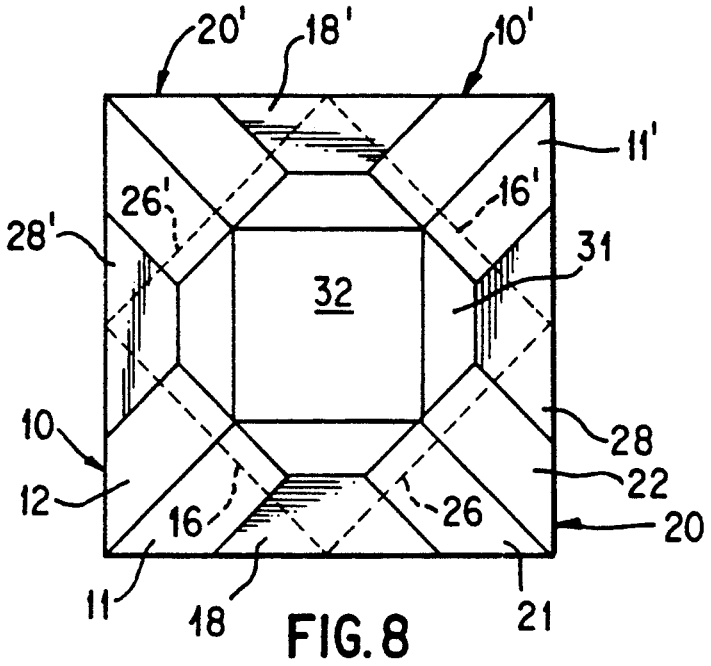
FIG. 8 is a plan view of four tetrahedrons arranged to provide four seats.

FIG. 8 shows an embodiment offering the highest space efficiency, with four tetrahedrons 10, 20, 10′, 20′ providing four seats 18, 28, 18′, 28′ facing outwardly at 90° intervals. Note that the support joints 16, 26, 16′, 26′ are arranged in a square.

Figure 9:
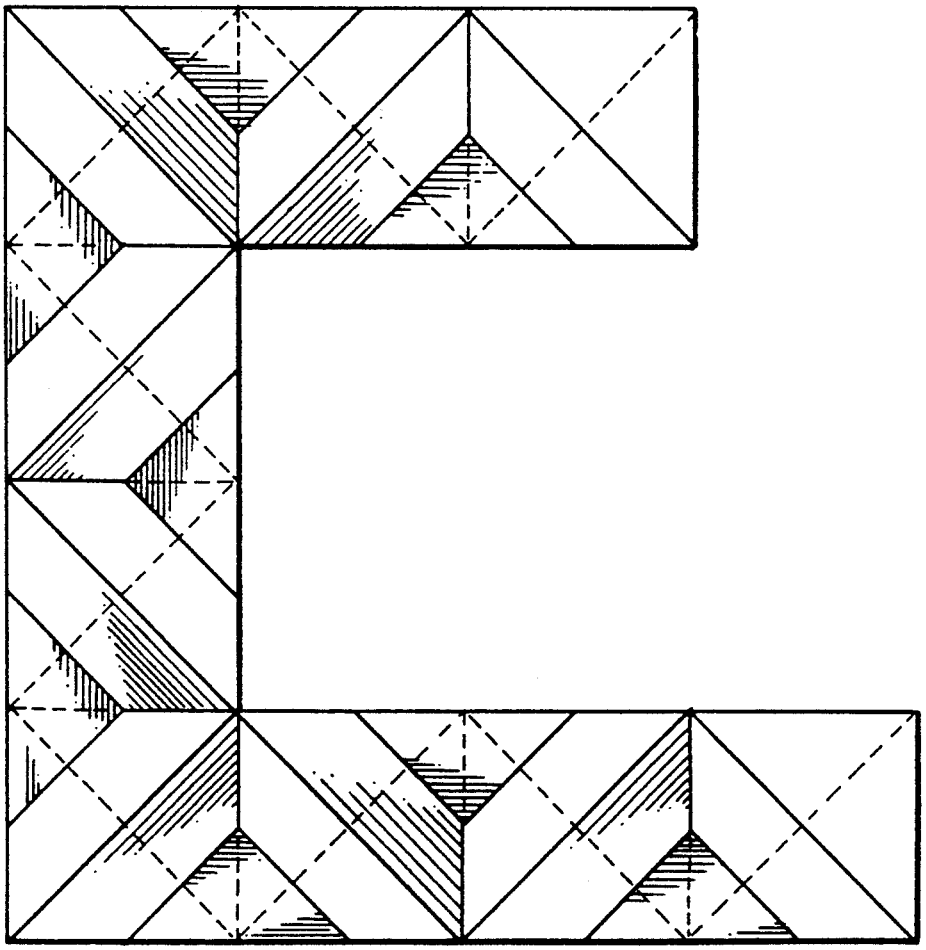
FIG. 9 a more extensive array of tetrahedrons arranged to provide mutually facing seats.

FIG. 9 shows a hybrid arrangement representing the principles of FIGS. 7 and 8, and further shows how mutually facing seats in a pit arrangement are possible.

In all arrangements modifications to improve comfort are possible. As illustrated in FIG. 8, trapezoidal backrests 31 may be provided between planes 11, 21, 22, 11′ etc. at an oblique angle to the seats 18, 28 etc. together with a planar surface 32 in the plane of top joints 13, 23. In the arrangement of FIG. 8 this yields a square table surface useful for supporting a lamp or a plant. Padding and fabric coverings would be expected.

The structural members would in themselves be of modular construction, for example, for six bars welded together at three way corners or extrusions fitted into trapezoidal butt joints. It is also possible to cast the chairs in concrete, which would be especially useful in parks and outdoor plazas.

Another possibility is to fabricate parallelograms of a formable material and fold them between opposed angles so that at least one joint is preformed. Two such preformed parallelograms could be placed together to form a tetrahedron. Alternatively, the preforms could be used as adjoining faces between adjacent tetrahedrons.

The foregoing is exemplary and not intended to limit the scope of the claims which follow. In particular, the inventive structure is not limited to a chair but may be used as a table, shelving, or other furniture.

I claim:

1. Furniture assembly comprising a pair of tetrahedrons which each comprise four triangular faces which meet in pairs to form six linear joints, said joints of each tetrahedron including a common joint at which one of the faces of each tetrahedron meets one of the faces of the other tetrahedron along said common joints to enclose an external angle outside of said tetrahedrons, said joints of each tetrahedron further including a support joint which meets the support joint of the other tetrahedron to define a support plane, said furniture assembly further comprising an at least substantially planar support member fixed between said faces enclosing said external angle, said support member being at least substantially parallel to said support plane.

2. Furniture assembly as in claim 1 wherein said tetrahedrons are equilateral tetrahedrons, each of said faces being outlined by an equilateral triangle, whereby each face meets each other face at an internal angle of 70°30'.

3. Furniture assembly as in claim 2 wherein said external angle is 109°30'.

4. Furniture assembly as in claim 3 comprising at least one additional equilateral tetrahedron having a face which meets a face of another said tetrahedron along a common joint to enclose a further external angle of 109°30' outside of said tetrahedrons, said at least one additional tetrahedron having a support joint which meets the support joint of said another tetrahedron in said common support plane, said furniture further comprising at least one additional support member fixed between said faces enclosing said further external angle.

5. Furniture assembly as in claim 4 comprising four said tetrahedrons fixed together along four common joints, and four support joints which form a square in said support plane.

6. Furniture assembly as in claim 4 wherein said support members lie in a common plane.

7. Furniture assembly as in claim 4 comprising at least three tetrahedrons arranged so that their support joints form a zig-zag pattern in said support plane.

8. Furniture assembly as in claim 1 further comprising a trapezoidal surface extending at an oblique angle to said support member between said faces enclosing said external angle.

9. Modular furniture comprising a pair of equilateral tetrahedrons which each comprise four equilateral triangular faces which meet in pairs to form six linear joints wherein each face meets each other face at an internal angle of 70°30', said joints of each tetrahedron including a common joint at which one of the faces of each tetrahedron meets one of the faces of the other tetrahedron along said common joints to enclose an external angle outside of said tetrahedrons, said joints of each tetrahedron further including a support joint which meets the support joint of the other tetrahedron to define a support plane, said furniture further comprising a support member fixed between said faces enclosing said external angle.

10. Modular furniture as in claim 9 wherein said external angle is 109°30'.

11. Modular furniture as in claim 10 comprising at least one additional equilateral tetrahedron having a face which meets a face of another said tetrahedron along a common joint to enclose a further external angle of 109°30' outside of said tetrahedrons, said at least one additional tetrahedron having a support joint which meets the support joint of said another tetrahedron in said common support plane, said furniture further comprising at least one additional support member fixed between said faces enclosing said further external angle.

12. Modular furniture as in claim 11 comprising four said tetrahedrons fixed together along four common joints, and four support joints which form a square in said support plane.

13. Modular furniture as in claim 11 wherein said support members lie in a common plane.

14. Modular furniture as in claim 11 comprising at least three tetrahedrons arranged so that their support joints form a zig-zag pattern in said support plane.

15. Modular furniture as in claim 9 wherein said support member is parallel to said support plane.

16. Modular furniture assembly as in claim 9 further comprising a trapezoidal surface extending at an oblique angle to said support member between said faces enclosing said external angle.

17. Furniture assembly consisting of a pair of tetrahedrons which each comprise four triangular faces which meet in pairs to form six linear joints, said joints of each tetrahedron including a common joint at which one of the faces of each tetrahedron meets one of the faces of the other tetrahedron along said common joints to enclose an external angle outside of said tetrahedrons, said joints of each tetrahedron further including a support joint which meets the support joint of the other tetrahedron to define a support plane, said furniture further consisting of a support member fixed between said faces enclosing said external angle.

18. Modular furniture as in claim 17 wherein said tetrahedrons are equilateral tetrahedrons, each of said faces being outlined by an equilateral triangle, whereby each face meets each other face at an internal angle of 70°30'.

19. Modular furniture as in claim 18 wherein said external angle is 109°30'.

20. Modular furniture as in claim 17 wherein said support member is parallel to said support plane.

* * * * *